US008453426B2

(12) United States Patent
Kueneman et al.

(10) Patent No.: US 8,453,426 B2
(45) Date of Patent: Jun. 4, 2013

(54) CURRENT CONTROLLED FIELD EMISSION THRUSTER

(75) Inventors: James D. Kueneman, Sonoita, AZ (US); Anton Vanderwyst, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1076 days.

(21) Appl. No.: 12/419,258

(22) Filed: Apr. 6, 2009

(65) Prior Publication Data

US 2010/0251690 A1 Oct. 7, 2010

(51) Int. Cl.
*F03H 1/00* (2006.01)
*B63H 11/00* (2006.01)

(52) U.S. Cl.
USPC ..... 60/202; 60/204

(58) Field of Classification Search
USPC ..... 60/202, 204; 313/359.1, 360.1, 361.1, 313/362.1, 363.1
See application file for complete search history.

(56) References Cited

U.S. PATENT DOCUMENTS

| | | | | |
|---|---|---|---|---|
| 4,088,919 | A * | 5/1978 | Clampitt et al. | 313/362.1 |
| 4,367,429 | A * | 1/1983 | Wang et al. | 313/362.1 |
| 4,733,134 | A * | 3/1988 | Tamura et al. | 315/111.81 |
| 5,339,623 | A | 8/1994 | Smith | |
| 6,481,672 | B1 * | 11/2002 | Goodzeit et al. | 244/169 |
| 7,827,779 | B1 * | 11/2010 | Krishnan et al. | 60/202 |
| 2009/0153015 | A1 * | 6/2009 | King | 313/359.1 |

OTHER PUBLICATIONS

Martin Tajmar, Experimental Validation of Mass-efficiency model for an indium liquid-metal ion source, published online: Dec. 17, 2002. Appl. Phys. A 76, 1003-1006 (2003).

* cited by examiner

*Primary Examiner* — Gerald Sung
(74) *Attorney, Agent, or Firm* — Renner, Otto, Boisselle & Sklar, LLP

(57) ABSTRACT

There is disclosed a field emission electric propulsion (FEEP) system including a FEEP thruster having at least one emitter and an extractor electrode, and a power supply. The power supply may provide an extractor voltage applied between the emitter and the extractor electrode. The power supply may be operable in a constant current mode in which the extractor voltage is controlled to set an ion current flowing from the emitter at a target current level.

20 Claims, 6 Drawing Sheets

CURRENT CONTROLLED FIELD EMISSION THRUSTER

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to electric propulsion for satellites and other spacecraft and to field emission electric propulsion (FEEP) thrusters in particular.

2. Description of the Related Art

Satellites and other spacecraft are launched using primary chemical rocket motors and then use secondary thrusters for navigation, orientation, and (in the case of satellites) orbit maintenance. The secondary thrusters require some form of fuel. The mass of the fuel and fuel-containing structures may be more than 50% of the total orbited mass (the mass the initially reaches orbit) of a satellite. Improving the efficiency of the secondary thrusters would allow less fuel mass for a specific orbital mission and thus potentially reduce the cost of constructing and launching a satellite.

The relative efficiency of rocket motors and thrusters is commonly defined by specific impulse ($I_{SP}$) which is roughly the number of seconds that one pound of fuel will produce one pound of thrust. Solid-fuel and liquid-fuel chemical rocket motors typically have specific impulse values from 150 to 400 seconds. The specific impulse of electric propulsion thrusters may be several thousand seconds or more.

Rocket motors and thrusters produce thrust by expelling mass. In the case of chemical rocket motors, the expelled mass is expanding combustion gases produced by burning a liquid or solid fuel. In the case of an FEEP thruster, the expelled mass is droplets or ions of a metal which are extracted from a reservoir of liquid metal "fuel" and accelerated by a high electric field. More specifically, droplets or ions of the liquid metal are extracted from the tip of a microscopic emitter needle which is coated with the liquid metal by surface tension or other mechanism. FEEP thrusters using a single emitter needle may produce a very low thrust level. Higher thrust levels may be produced by FEEP thrusters that incorporate a large plurality of emitter needles.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Figure 1:
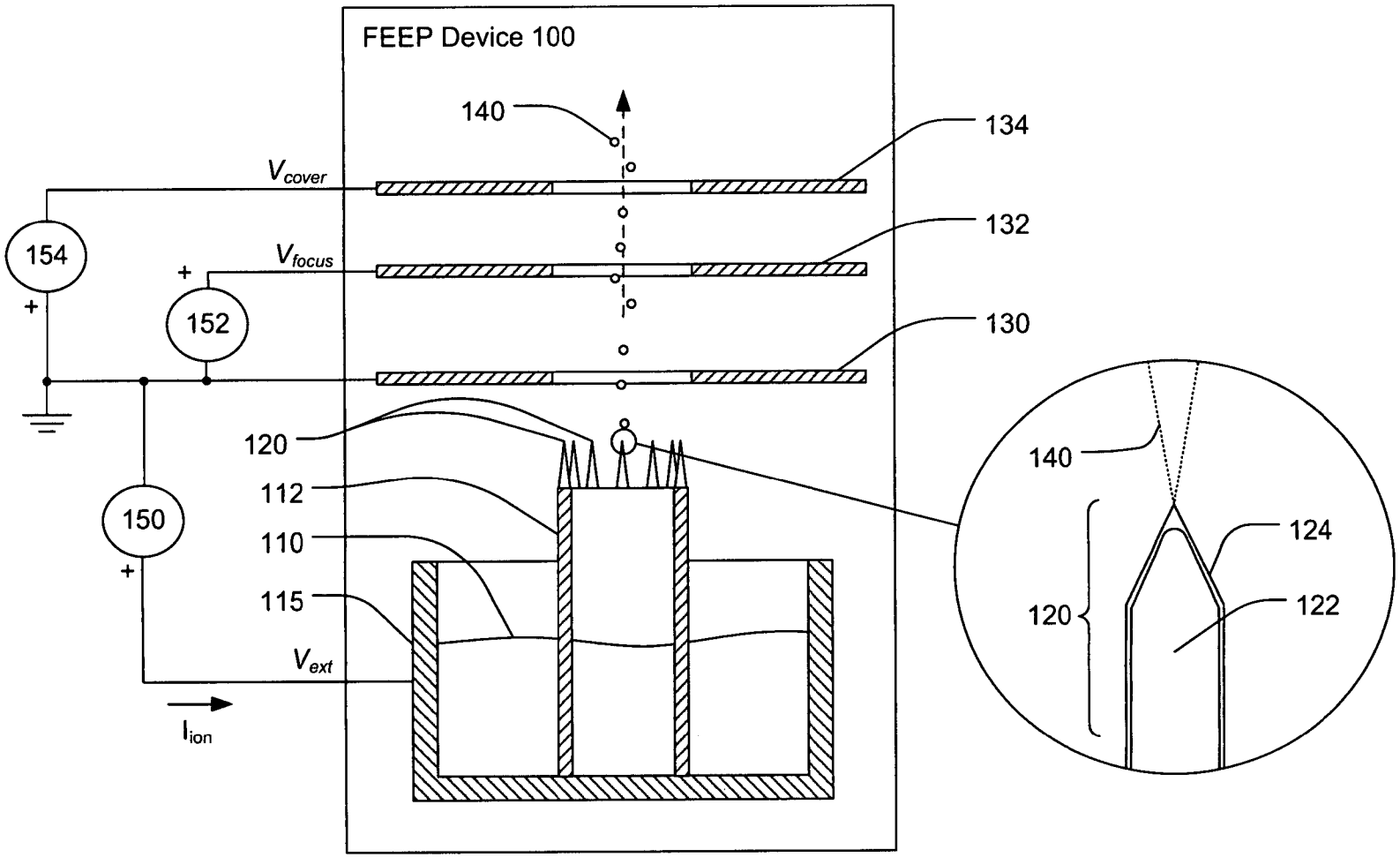
FIG. 1 is a schematic cross-sectional view of a multiple-emitter FEEP thruster.

Referring now to FIG. 1, an exemplary multiple emitter FEEP thruster 100 may include a plurality of emitters 120 and an extractor electrode 130. The plurality of emitters may be disposed on a pedestal 112. While a total of 12 emitters, not all of which are visible, is implied in FIG. 1, a FEEP thruster may have fewer or more emitters. A FEEP thruster may have a large numbers of emitters disposed in a circle, as shown in FIG. 1, an array, or some other arrangement. The plurality of emitters may be connected to a common electrical conductor such as the pedestal 112.

The pedestal 112 may be partially submerged in or otherwise coupled to a pool of a liquid metal 110 held in a reservoir 115. The liquid metal 110 may be, for example, gallium or indium. The reservoir 115 may include a heater and/or insulating layers, not shown in FIG. 1, to maintain the liquid metal 110 in a liquid state. The pedestal may be adapted to allow a portion of the liquid metal 110 to flow to the emitters 120 due to surface tension, capillary action, or other mechanism.

As shown in Detail A, each emitter 120 may consist of a thin metal needle 122 coated with an even thinner layer 124 of the liquid metal. When a sufficient extractor voltage $V_{ext}$ is applied between the emitters 120 and the extractor electrode 130, some of the liquid metal may be pulled or extracted from the tip of at least some of the emitter needles. The extracted liquid metal 140 may be in the form of ionized atoms and/or microdroplets.

An extractor power supply 150 may provide the extractor voltage. The flow of extracted liquid metal may cause a corresponding current $I_{ion}$ to flow from the extractor power supply 150. The term "ion current" will be used to describe both the current flow from the emitter needles, which encompasses both true ions (ionized atoms) and ionized particles, and the current flow from the extractor power supply. The emitter power supply 150 may be adapted to regulate the extractor voltage $V_{ext}$. The emitter power supply 150 may be adapted to regulate the current $I_{ion}$. The emitter power supply 150 may be controllable to operate in either a regulated voltage or regulated current mode.

The FEEP device 100 may include other electrodes, such as, but not limited to, a focus electrode 132 and a cover electrode 134. If present, the focus and cover electrodes 132, 134 may be effective to focus and direct the flow of extracted liquid metal 140. A focus power supply 152 may provide a voltage $V_{focus}$ applied between the focus electrode 132 and the emitter electrode 130. A cover power supply 154 may provide a voltage $V_{cover}$ applied between the cover electrode 134 and the emitter electrode 130.

Figure 2:
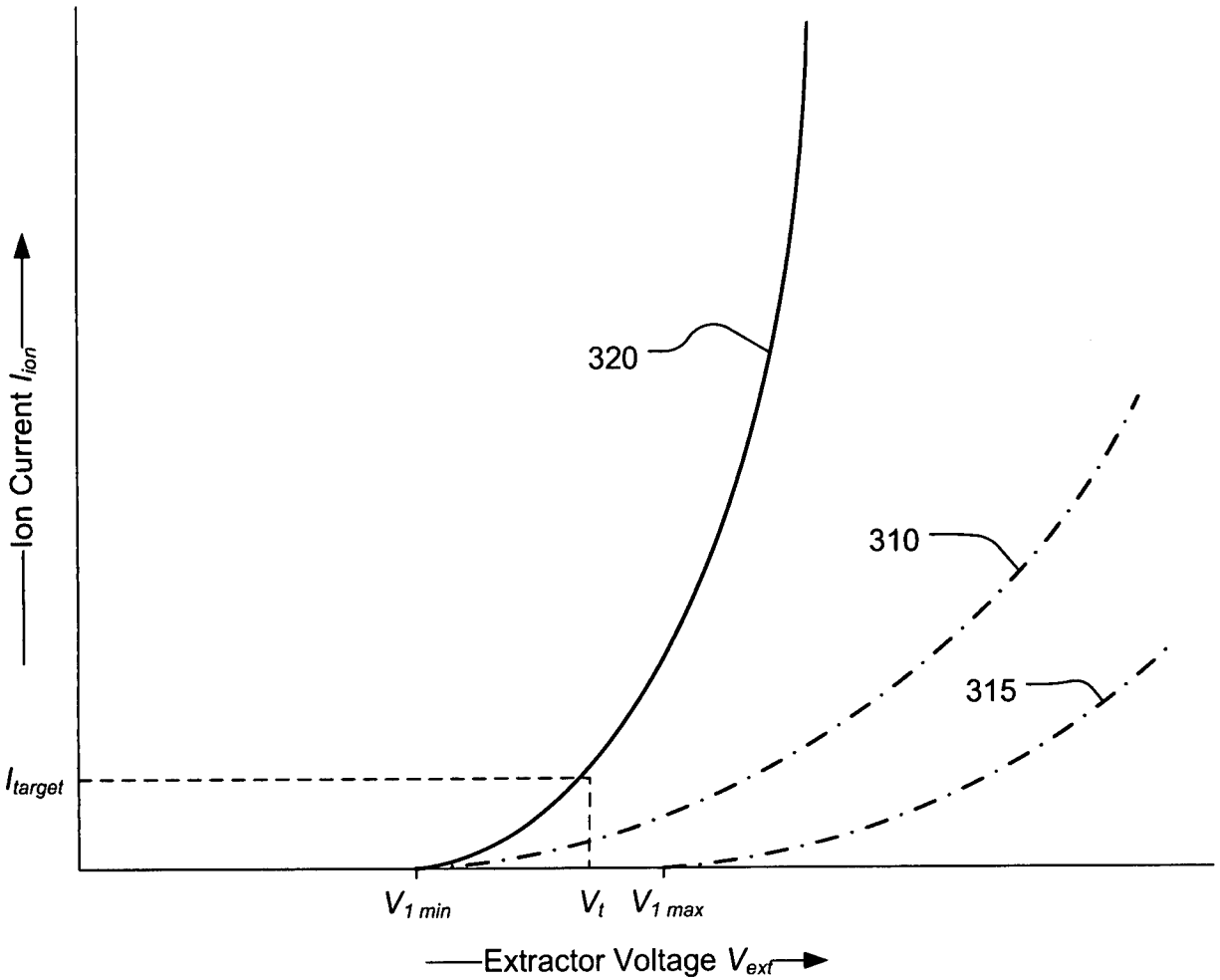
FIG. 2 is a graph showing current-voltage characteristics of an exemplary multiple-emitter FEEP thruster.

FIG. 2 is a graph showing the ion current $I_{ion}$ versus extractor voltage $V_{ext}$ characteristics of an exemplary FEEP thruster. The characteristics plotted in FIG. 2 are based on published data for specific FEEP devices but may not be representative of all FEEP configurations. As shown by the dashed lines 310 and 315, the ion current of a single FEEp emitter may be a roughly exponential function of the extractor voltage for extractor voltages above a minimum voltage $V_1$ required to initiate extraction of metal particles from the emitter. Thus the ion current $I_{ion}$ of a single emitter may be expressed by the formula $$I_{ion} \approx c(V_{ext}-V_1)^d \quad (1)$$

where c and d are constants for a specific emitter and $V_1$ is a threshold voltage for ion extraction.

The constants c and d and the threshold voltage $V_1$ may vary between the emitters of a multiple-emitter FEEP thruster due to manufacturing tolerances and random variations. In FIG. 2, the broken line 310 represents the characteristic of the FEEP emitter which has the lowest threshold voltage $V_{1\ min}$, among a plurality of emitters of a multiple-emitter FEEP thruster. Similarly, the broken line 315 represents the characteristic of the FEEP emitter which has the highest threshold voltage $V_{1\ max}$ among the plurality of emitters. The relative difference between $V_{1\ max}$ and $V_{1\ min}$ may be exaggerated in FIG. 2 for ease of explanation. In the case where one or more of the plurality of emitters are incapable of emitting due to a manufacturing defect, the curve 315 may represent the characteristic of the FEEP emitter which has the highest threshold voltage $V_{1\ max}$ among the plurality of emitters capable of emitting. The current versus voltage characteristics of the other emitters of the plurality of emitters, which are not shown, may fall between the line 310 and the line 315.

The curve 320 represents the sum of the current from the plurality of emitters. For extractor voltage values between $V_{1\ min}$ and $V_{1\ max}$, the total current from the plurality of emitters may depend on the number of emitters that are actually emitting as well as the current per emitting emitter. Thus the total current may be roughly an exponential function of voltage for extractor voltage values above $V_{1\ min}$.

Although not shown in FIG. 2, the ion-current versus extractor voltage characteristics of a FEEP thruster may be hysteretic and/or time-varying. Specifically, the extractor voltage required to sustain a target ion current level may, in the short term, be less than the extractor voltage required to initiate the ion current at the target level. For example, the voltage required to initiate the ion current at the target level may be high due to incomplete wetting of the emitter needles with the liquid metal; the extractor voltage needed to sustain the target current level may decline as the needles become completely wetted. In the longer term, the extractor voltage required to provide the target current may increase due to, for example, erosion of the tips of the emitter needles. The ion-current versus extractor voltage characteristics of a FEEP thruster may also depend on temperature and other environmental conditions.

The thrust provided by a FEEP thruster may be approximated by the equation $$F \approx kI_{ion}\sqrt{V_{ext}} \quad (2)$$

where F is the thrust and k is a constant. The voltage $V_{ext}$ between the emitters and the extractor electrode of the FEEP thruster may be provided by a power supply (150 in FIG. 1) that may operate in either a regulated voltage or a regulated current mode. In the interest of mathematical simplicity, the following analysis assumes that d=1 for each FEEP emitter, which is to say that the current the thrust produced by each emitter varies linearly with extractor voltage above the associated threshold voltage.

When the FEEP thruster is driven by a regulated voltage power supply, equations (1) and (2) can be combined as follows:

$$F \approx kc(V_{ext}-V_1)\sqrt{V_{ext}} \quad (3)$$

where $V_{ext}$ is held constant by the power supply. The force F produced by a FEEP thruster is linearly dependent on c and on $(V_{ext}-V_1)$, and thus highly susceptible to random variations in c and $V_1$.

When the power supply operates in the regulated current mode, equations (1) and (2) can be combined as follows:

$$F \approx kI_{ion}\sqrt{\frac{I_{ion}}{c}+V_1} \quad (4)$$

where $I_{ion}$ is held constant by the power supply. Comparing equations (3) and (4), the dependence of F on c and $V_1$ is substantially less when the power supply is operated in the regulated current mode. Powering a FEEP thruster with a power supply operating in a regulated current mode may provide more accurate control of the thrust, lower thrust noise, and improved tolerance for manufacturing variations and long term degradation of the emitter needles. The relative advantages of powering a FEEP thruster with a power supply operating in a regulated current mode may be even greater for emitters where the constant d has a value greater than one.

FIG. 2 shows a possible situation where a target ion current $I_{target}$ may require an initial extractor voltage $V_t$ which is less than $V_{1\ max}$. The FEEP thruster may be driven by a power supply that provides either a regulated voltage $V_t$ or a regulated current $I_{target}$. In either case, the ion current $I_{target}$ may be extracted from only a portion of the FEEP emitters. Specifically, emitters having $V_1$ less than $V_t$ may emit ions and emitters having $V_1$ greater than $V_t$ may not emit ions. In this case, the reliability and life of the FEEP thruster may be adversely affected. The maximum thruster life may be obtained at a given thrust level if the ion current is divided evenly, or nearly evenly, among as many FEEP emitters as possible.

Figure 3:
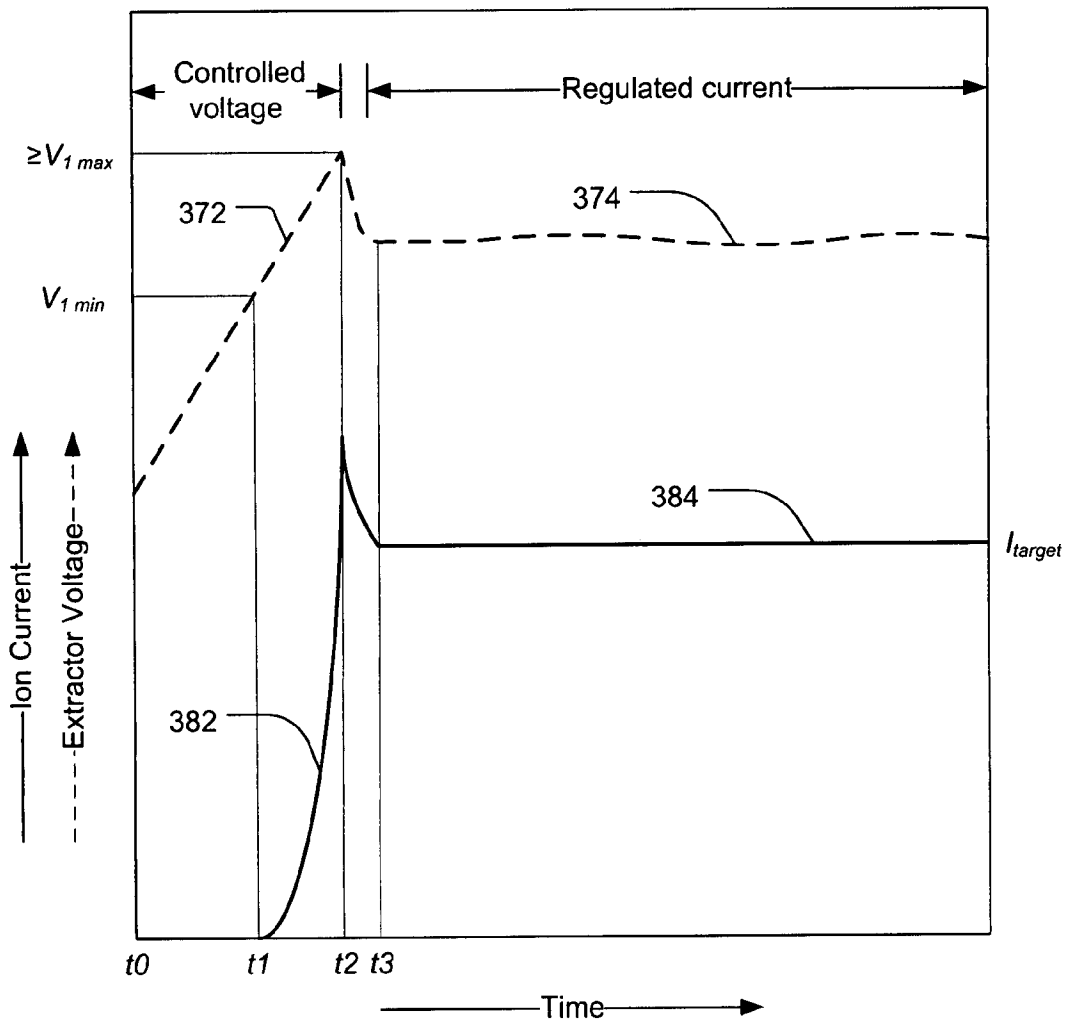
FIG. 3 is a graph showing emitter voltage and ion current during operation of a multiple-emitter FEEP thruster.

FIG. 3 is a graph of the applied extractor voltage and the resulting ion current, in arbitrary units, versus time for a FEEP thruster operated in a manner that may divide the ion current evenly, or nearly evenly, among as many FEEP emitters as possible. Starting at a time t0, which may be upon receipt of a command to produce a certain level of thrust, the extractor voltage may be increased, as represented by the dashed line 372. At a time t1, the extractor voltage may exceed $V_{1\ min}$ and ion current may start to flow from at least one emitter of the FEEP thruster, as represented by the solid curve 382. At a later time t2, the extractor voltage may reach a maximum value which may be greater than $V_{1\ max}$. At time t2, substantially all of the FEEP emitters may be emitting ion current. From time t0 to time t2, a power supply providing the extractor voltage may be operating in a controlled voltage mode. In the controlled voltage mode, the extractor voltage may be controlled without dependence on the ion current. After time t2, the power supply providing the extractor voltage may be set to operate in a regulated current mode. In the regulated current mode, after time t3, the extractor voltage, represented by the dashed curve 374, may be varied as needed to maintain the ion current flow, represented by the solid line 384, constant at a target level $I_{target}$.

The time intervals shown in FIG. 3 are adapted for ease of explanation. The time scale in FIG. 2 may be non-linear or inconsistent. For example, the actual time period from t0 to t3 may be a fraction of a second and the time period after t3 may be many seconds or longer. Other time intervals may be used.

The maximum value of the extractor voltage at time t2 may be predetermined based on, for example, the design of the FEEP thruster or measurements made on the actual FEEP thruster hardware. The maximum value of the extractor voltage at time t2 may be determined, at least in part, from a relationship between the ion current and the extractor voltage. For example, when the FEEP thruster has a small number of emitter needles, the onset of ion current flow from each of the emitter needles may cause an abrupt change in the slope of the ion current versus extractor voltage characteristic. In this case, the changes in the slope of the ion current versus extractor voltage characteristic may be counted. The extractor voltage may be increased until all of the emitter needles are emitting ion current or until a predetermined absolute maximum voltage value is reached.

When the FEEP thruster has a large plurality of emitter needles, counting the onset of ion flow from the individual emitter needles may not be practical. In this case, the extractor voltage may be increased until the slope of the ion current versus extractor voltage characteristic becomes constant, or until the rate of change of ion current with respect extractor voltage is less than a predetermined threshold, or until a predetermined absolute maximum voltage value is reached.

Figure 4:
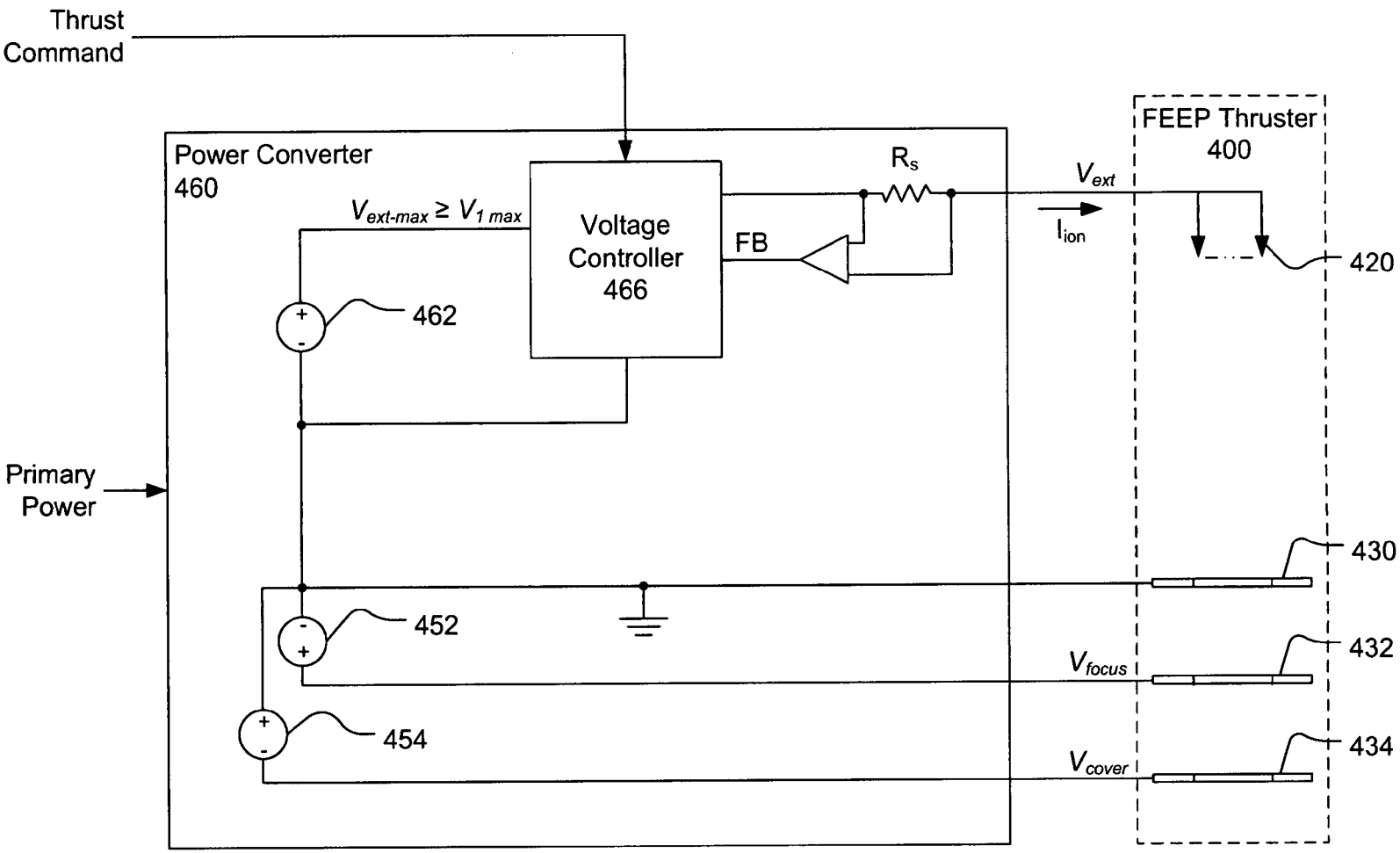
FIG. 4 is a block diagram of a FEEP thruster system.

Referring now to FIG. 4, a FEEP thruster system may include a FEEP thruster 400, and a power converter 460. The FEEP thruster 400 may include a plurality of emitters 420 and an extractor electrode 430. FEEP thruster 400 may include other electrodes such as, but not limited to, a focus electrode 432 and a cover electrode 434. The power converter 460 may provide a voltage $V_{ext}$ to the plurality of emitters 420. When the focus electrode 432 is included in the FEEP thruster 400, the power converter 460 may include a corresponding source 452 to provide a voltage $V_{focus}$ to the focus electrode 432. When the cover electrode 434 is included in the FEEP thruster 400, the power converter 460 may include a corresponding source 454 to provide a voltage $V_{cover}$ to the cover electrode 434. As shown in FIG. 4, all of the voltages $V_{ext}$, $V_{focus}$, and $V_{cover}$ are defined with respect to the extractor electrode 430.

The power converter 460 may include a voltage controller 466 to control the voltage $V_{ext}$ applied to the plurality of emitters 420 of the FEEP thruster 400. The voltage controller may receive a voltage $V_{e\ max}$ from a source 462. The voltage $V_{e\ max}$ may be equal to or greater than a voltage $V_{1\ max}$ required to ion current flow from substantially all of the plurality of emitters 420.

The voltage controller 466 may receive a feedback signal FB indicative of the ion current $I_{ion}$ emitted by the plurality of emitters 420. As shown in FIG. 4, the feedback signal FB may be generated by sensing a voltage drop across a sensing resistor Rs in series with the plurality of emitters 420. Other circuits for providing the feedback signal FB may be used. The voltage controller 466 may be adapted to operate in a controlled voltage mode wherein the voltage $V_{ext}$ is controlled independent of the ion current $I_{ion}$. The controller may be adapted to operate in a regulated current mode wherein the voltage $V_{ext}$ is controlled based on the feedback signal FB so as to regulate the current $I_{ion}$. The voltage controller 466 may be adapted to selectively operate in the controlled voltage mode or the regulated current mode.

The controller 466 may receive a thrust command from a processor or other source external to the FEEP thruster system. In response to the thrust command, the controller 466 may control the voltage $V_{ext}$ as shown in FIG. 3. The controller 466 may control the voltage $V_{ext}$ to perform the processes subsequently described herein.

The controller 466 may include various specialized units, circuits, firmware, software and interfaces for providing the functionality and features described here. The controller may therefore include one or more of: logic arrays, memories, analog circuits, digital circuits, software, firmware, and processors such as microprocessors, field programmable gate arrays (FPGAs), application specific integrated circuits (ASICs), programmable logic devices (PLDs) and programmable logic arrays (PLAs). The processes, functionality and features may be embodied in whole or in part in software which operates on one or more processors within the controller 466. The hardware and software and their functions may be distributed such that some components are performed by the controller 466 and others by other devices.

Description of Processes

Figure 5:
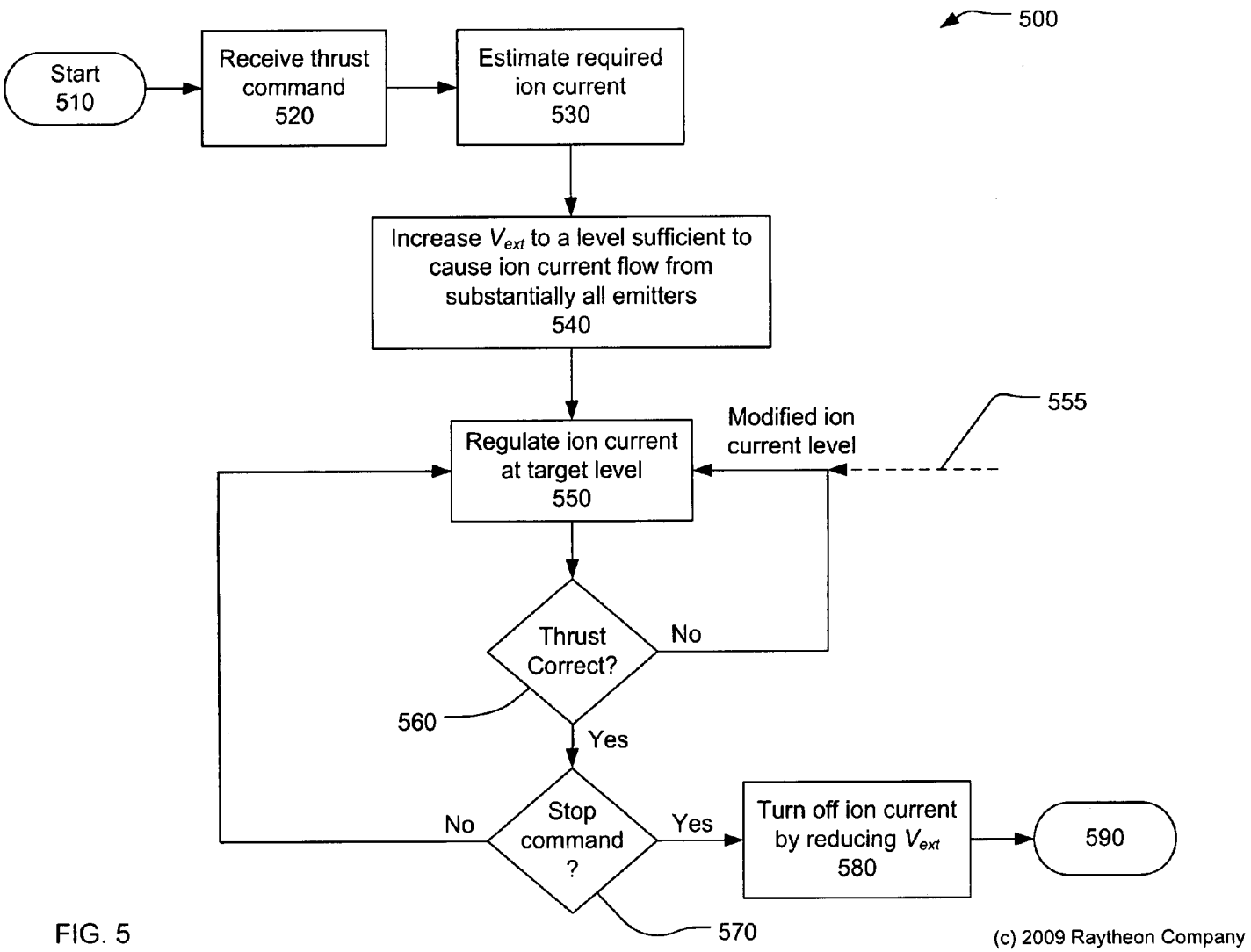
FIG. 5 is a flow chart of a process for operating a FEEP thruster system.

Referring now to FIG. 5, a flow chart of a process 500 for operating a FEEP thruster has both a start 510 and a finish 580. The process 500 may be repeated, possibly a large number of times, during the life cycle of a spacecraft incorporating the FEEP thruster.

At the start 510 of the process 500, the FEEP thruster is in an off state, which is to say that the FEEP thruster is producing no thrust or an insignificant level of thrust. At 520, a thrust command may be received from a processor or other entity external to the FEEP thruster. The thrust command may include a commanded thrust level and may include other information such as a duration that the target thrust level is to be provided.

At 530, an initial target ion current level may be estimated based on the commanded thrust level. The initial target ion current level may be estimated from the commanded thrust level using, for example, a look-up table or a formula or another method. The look-up table and/or formula may have been predetermined, for example, based on the FEEP thruster design or test data.

At 540, a voltage $V_{ext}$ applied between an emitter or plurality of emitters and an extractor electrode with the FEEP thruster may be increased to a maximum level. The maximum level may be sufficient to cause ion current to flow from substantially all of the plurality of emitters. The maximum voltage may be predetermined, or may be determined from a relationship between the ion current level and the applied voltage $V_{ext}$. For example, the voltage $V_{ext}$ may be increased until a rate of change of the ion current with voltage becomes constant, indicating that substantially all of the emitters are emitting ion current.

After the voltage $V_{ext}$ has been raised to the maximum value at 540, at 550 the voltage $V_{ext}$ may be controlled to regulate the ion current at the target ion current level determined at 530. At 560, the thrust actually being produced by the FEEP thruster may be estimated from the applied voltage $V_{ext}$ and the ion current level. If the thrust produced by the FEEP thruster is not equal to the commanded thrust level, for example due to aging of the thruster emitters, the target ion current level may be changed at 550.

At 570, a determination may be made if the thrust should be stopped. The determination may be made based on, for example, receipt of a command to stop the thrust or the completion of the duration specified in the thrust command received at 520. When a determination is made that the thrust should be stopped, the ion current may be turned off at 580 by appropriately reducing the voltage $V_{ext}$, and the process 500 may finish at 590.

When a determination is made at 570 that the thrust should be continued, the process 500 may return to 550. Although the actions at 550, 560, and 570 are shown as sequential, these actions may be essentially simultaneous. The process 500 may loop between 550 and 570 until a determination is made to stop the thrust. While the process 500 is looping between 550 and 570, the target ion current level may be modified, as indicated by the dashed line 555, in response to additional thrust commands.

Figure 6:
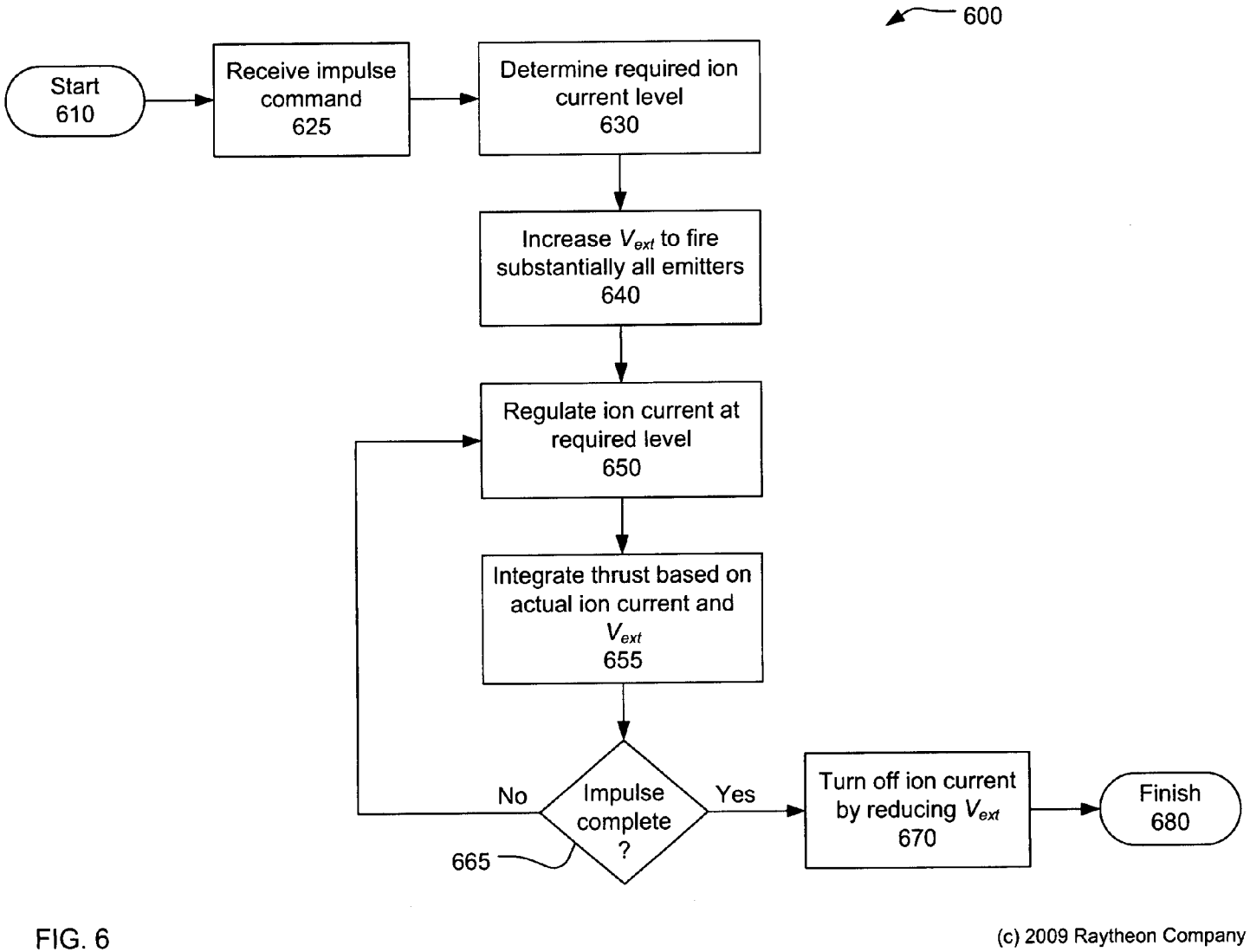
FIG. 6 is a flow chart of a process for operating a FEEP thruster system.

FIG. 6 is a flow chart of another process 600 for operating a FEEP thruster. The process 600 is generally similar to the process 500, and only the difference between the processes 500 and 600 will be described.

At 620, a thrust command including a commanded impulse may be received. The thrust command may optionally include a commanded thrust level. At 630, a required ion current level may be determined. The required ion current level may be based on the commanded thrust level, if included in the thrust command received at 620. In the absence of a commanded thrust level, the required ion current may be determined, for example, at a level that may maximize the efficiency of the FEEP thruster.

At 655, the actual thrust produced by the FEEP thruster may be estimated from the actual ion current and applied voltage $V_{ext}$ and integrated to estimate the impulse produced by the FEEP thruster. At 665, a determination may be made to stop or continue to provide thrust based on a comparison of the estimated impulse from 655 and the commanded impulse received at 620. Specifically, the thrust may be stopped when the estimated impulse equals or exceeds the commanded impulse.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A field emission electric propulsion (FEEP) system, comprising: a FEEP thruster including at least one emitter and an extractor electrode; a power supply to provide an extractor voltage applied between the at least one emitter and the extractor electrode; and a resistor in series with the thruster; wherein the power supply is operable in a regulated current mode in which the extractor voltage is controlled by a controller of the power supply that is configured to regulate the ion current flowing from the at least one emitter at a target ion current level, based on a feedback signal generated from the current flow through the resistor.

2. The FEEP system of claim 1, wherein the power supply is further operable, upon receipt of a thrust command, to increase the extractor voltage to a maximum voltage level and then reduce the extractor voltage to regulate the ion current flowing from the emitter at the target ion current level.

3. The FEEP system of claim 2, wherein the power supply is further operable, upon receipt of the thrust command, to determine the target ion current level based on a thrust level included in the thrust command.

4. The FEEP system of claim 2, wherein the maximum voltage level is predetermined.

5. The FEEP system of claim 2, wherein the maximum voltage level is determined based on a relationship between the extractor voltage and the ion current.

6. The FEEP system of claim 5, wherein the maximum voltage level is a voltage level where a rate of change of ion current with extractor voltage becomes constant.

7. The FEEP system of claim 2, wherein the at least one emitter is a plurality of emitters.

8. The FEEP system of claim 7, wherein the maximum voltage level is sufficient to cause substantially all of the plurality of emitters to emit ion current.

9. The FEEP system of claim 2, wherein the power supply is further operable to determine an instantaneous thrust level from the extractor voltage and ion current, and to integrate the instantaneous thrust level over time to calculate an impulse.

10. The FEEP system of claim 1, wherein the power supply includes a voltage source; and wherein the controller is between the voltage source and the FEEP thruster.

11. The FEEP system of claim 10, wherein the controller is adapted to:

receive a thrust command;

determine the target ion current level based on the thrust command; and increase the extractor voltage to a maximum voltage level and then reduce the extractor voltage to regulate the ion current at the determined target ion current level.

12. A method of operating a field emission electric propulsion (FEEP) thruster, the FEEP thruster comprising at least one emitter and an extractor electrode, comprising: receiving a thrust command; determining a target ion current level based on the thrust command; and controlling an extractor voltage applied between the at least one emitter and the extractor electrode of the FEEP thruster to regulate an ion current flowing from the at least one emitter, at the target ion current level; wherein the controlling includes controlling based on a feedback signal generated from current flow through a resistor that is in series with the FEEP thruster.

13. The method of operating a FEEP thruster of claim 12, further comprising:

after determining the target ion current level, increasing the extractor voltage to a maximum voltage level and then reducing the extractor voltage to regulate the ion current at the target ion current level.

14. The method of operating a FEEP thruster of claim 13, wherein the maximum voltage level is predetermined.

15. The method of operating a FEEP thruster of claim 13, wherein the maximum voltage level is determined based on a relationship between the extractor voltage and the ion current.

16. The method of operating a FEEP thruster of claim 15, wherein the maximum voltage level is a voltage level where a rate of change of ion current with extractor voltage becomes constant.

17. The method of operating a FEEP thruster of claim 13, wherein the at least one emitter is a plurality of emitters.

18. The method of operating a FEEP thruster of claim 17, wherein the maximum voltage level is sufficient to cause substantially all of the plurality of emitters to emit ion current.

19. The method of operating a FEEP thruster of claim 13, further comprising:

determining an instantaneous thrust level from the extractor voltage and ion current, and integrating the instantaneous thrust level over time to calculate an impulse.

20. The method of operating a FEEP thruster of claim 19, further comprising: reducing the extractor voltage to a level where the ion current is zero when the calculated impulse is equal to a target impulse level included in the thrust command.

* * * * *